United States Patent [19]

Gunn

[11] Patent Number: 4,628,624

[45] Date of Patent: Dec. 16, 1986

[54] VEHICLE DOOR-MOUNTED SIGN HOLDER

[76] Inventor: Donald F. Gunn, P.O.Box 565, Arapahoe, Nebr. 68922

[21] Appl. No.: 716,998

[22] Filed: Mar. 28, 1985

[51] Int. Cl.[4] ..... G09F 21/04

[52] U.S. Cl. ..... 40/591; 40/590

[58] Field of Search ..... 40/591, 592

[56] References Cited

U.S. PATENT DOCUMENTS

| | | | |
|---|---|---|---|
| 1,557,955 | 10/1925 | Young . | |
| 1,567,337 | 12/1925 | Siever . | |
| 1,833,474 | 11/1931 | Robinson . | |
| 1,989,781 | 11/1933 | Zak . | |
| 2,214,302 | 9/1940 | Keller et al. | 40/591 |
| 2,620,579 | 12/1952 | Dienes | 40/591 |
| 2,675,983 | 4/1954 | King . | |
| 3,255,542 | 6/1966 | DeVane | 40/591 |
| 3,393,464 | 7/1968 | DeVane | 40/591 |
| 3,461,584 | 8/1969 | Wilson | 40/591 |

*Primary Examiner*—Robert Peshock
*Assistant Examiner*—J. Hakomaki
*Attorney, Agent, or Firm*—E. Robert Newman

[57] ABSTRACT

A sign holder having two identical support members, one in a lower position and one in an upper position. Pockets in the support members hold the edges of a sign, and extendable arms telescoping from each end of the support members have curved ends for engaging the edges of a vehicle door. Each arm is fastened to the inside surface of the door edge with a set screw. Door-abutting faces of each arm are lined with soft material, and door-adjacent faces of the support members have rubber nubs attached thereto so that the door's finish will not be scratched or marred.

5 Claims, 5 Drawing Figures

VEHICLE DOOR-MOUNTED SIGN HOLDER

TECHNICAL FIELD

The present invention relates generally to sign holders which are removably attached to vehicle doors.

BACKGROUND ART

Vehicle door-mounted sign holders have long been known in the prior art. But, such prior art devices still suffer several problems.

One major problem is that prior art sign holders may be removed from the vehicle without having to open the door. This is a particular problem for those who have expensive signs displayed on their vehicles, and therefore do not want them easily removed by a passer-by, yet wish to have the signs easily transferable to other vehicles.

Those sign holders which will adjust to various sizes of vehicle doors are burdened with many small parts which must be moved or adjusted, and thereby increase the likelihood of mechanical faults or failure. The cost of maintaining a device with many moving parts would also be inherently greater than one with few total parts and fewer still which move.

Another problem, related to devices which have their adjustment mechanisms located on the outside of a vehicle door, is the effect of weather on those parts which must be adjusted. Dirt and corrosion can quickly make it difficult or impossible to turn adjustment screws or adjust other small moving parts—a problem which increases with a larger number of moving parts.

DISCLOSURE OF THE INVENTION

It is therefore a general object of the present invention to provide an improved vehicle door-mounted sign holder.

Another object is to provide a sign holder which is easily removed and adjusted to various sizes of vehicle doors.

A further object of the present invention is to provide a sign holder which may not be removed without first opening the door to which it is mounted.

More generally, it is an object of the instant invention to provide a sign holder having upper and lower support members which border the edges of a sign, and telescoping connector arms having a portion affixed to the ends of each support member, for grasping the edges of a vehicle door. The grasping portion of each arm is fastened to the inside surface of the door edge with a set screw, and the door-abutting portions of the arms are lined with soft material to avoid scratches and marring. The support members are held spaced away from the door's face using small rubber nubs affixed to the members.

These and other objects, advantages and novel features of the present invention will become apparent from the following detailed description of the invention when considered in conjunction with the accompanying drawings.

BEST MODES FOR CARRYING OUT THE INVENTION

Figure 1:
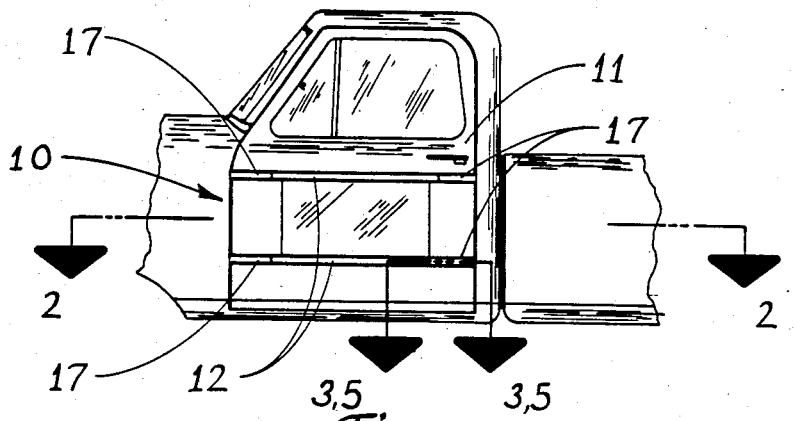
FIG. 1 is a side elevational view of a portion of a vehicle showing the invention attached thereto.
Figure 2:
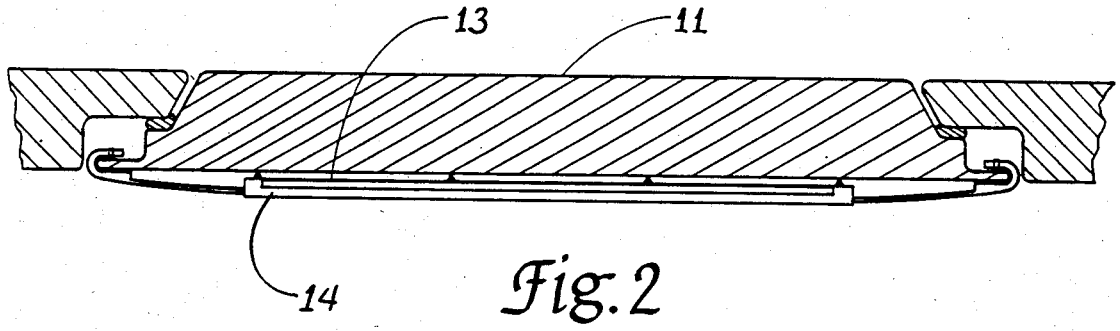
FIG. 2 is an enlarged cross-sectional view taken at line 2—2 in FIG. 1.
Figure 3:
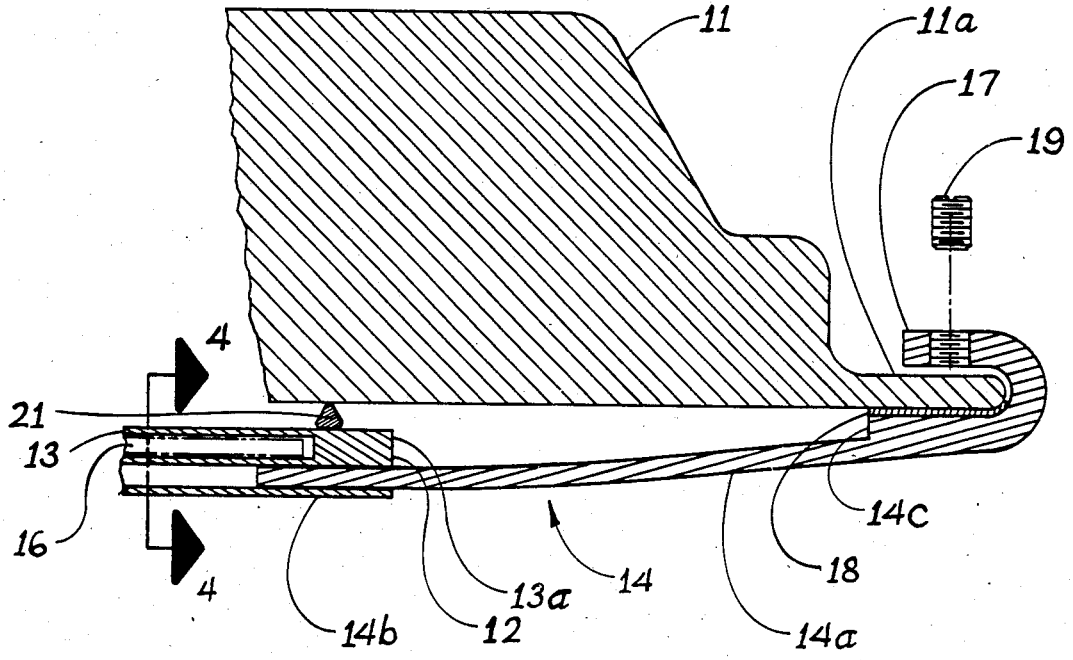
FIG. 3 is a super-enlarged cross-sectional view taken at line 3—3 in FIG. 1.

Referring now to the drawings, in which identical or corresponding parts are indicated by the same reference character throughout the several views, and more particularly to FIG. 1, the sign holder device is designated generally at 10, and is fastened to a vehicle door 11.

Referring now to FIGS. 1 through 4, sign holder 10 includes two identical horizontal support members 12, each having a pocket portion 13. One member 12, is located near the bottom of the door, and has its pocket portion 13 directed upwards. The other member 12 is located near the top of the door and has its pocket portion 13 directed downwards.

Each support member 12 has a telescoping connector arm 14 attached at each end. Each telescoping connector arm 14 includes a slidable arm portion **14*a* and an affixed sleeve portion 14*b*. In the described embodiments of the invention the affixed portions 14*b* of telescoping connector arms 14 are connected end to end to form a single elongated sleeve portion 14*b* equal in length to support member 12. This elongated sleeve 14*b* is longitudinally slotted and affixed to a side of support member 12**.

Figure 4:
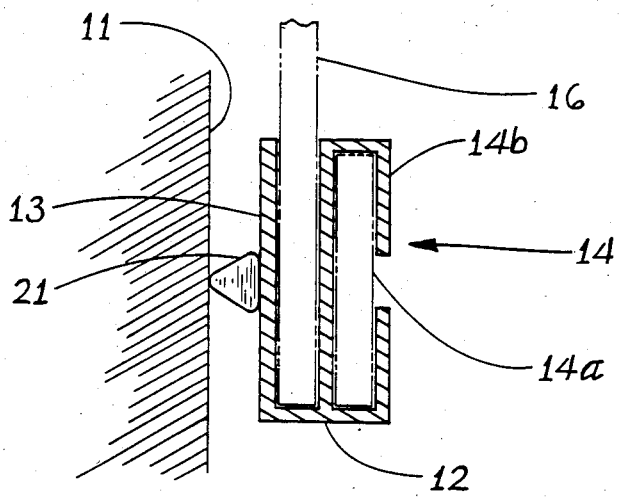
FIG. 4 is a super-enlarged cross-sectional view of the device taken at line 4—4 in FIG. 3.

As seen in FIG. 4, pocket portion 13 has a cross-section in the shape of a "U", and slotted sleeve portion **14*b* has a cross-section in the shape of a "C", the back of sleeve portion 14*b* and a wall of pocket portion 13 being a common element between the two. As seen on FIG. 3, a sign 16 inserted in pocket portion 13 cannot slide out of the ends thereof. Thus, in use, a sign 16 will be held between upper and lower support members 12 within their respective pocket portions 13**.

Arm portion **14*a* is slidably inserted within the end of each sleeve portion 14*b*. Each slidable arm portion 14*a* has an inwardly curving end 17 bent parallel to the main body of slidable arm 14*a* so as to grasp the peripheral edge 11*a* of door 11. A layer of soft material 18 lines the door-abutting portion of arm 14*a* to prevent the finish at the edge of door 11 from being scratched or marred. Curved end 17 is punched and tapped to receive a threaded set screw 19, which is tightened against the inside surface of door edge 11*a* to fasten arm 14*a* to door 11**.

A wedge-shaped portion **14*c* of arm 14*a* is located abutting the outside face of door edge 11*a* proximal curved end 17 with the thicker portion thereof distal curved end 17, and serves to hold the main body of arm 14*a* from door 11**.

Rubber nubs 21 are affixed to the door-adjacent face of support members 12, and serve to protect the door's finish from being scratched or marred. By spacing support member 12 away from door 11 the chance of non-uniform fading of the paint behind support members 12 is reduced, since direct sunlight reaches points behind support members 12.

Thus, it may be seen that telescoping connector arms 14 affixed to support members 12, may be adjusted to properly accommodate various sizes of vehicle doors. The width and thickness of arm **14*a* is such that sleeve portion 14*b* must expand slightly as arm 14*a* is inserted therewithin. Thus, sleeve portion 14***b* will tend to clamp on arm 14*a* and be held in place.

Each arm 14*a* is flexed slightly in order that bent portion 17 may grasp an edge of door 11*a*. This flexing will in turn cause sleeve portion 14*b* to crimp slightly upon arm 14*a*, thereby producing an additional "grip" on arm 14*a*. As set screws 19 are threaded inwardly, curved end 17 of arm 14*a* will clamp upon door edge 11*a* and temporarily fasten arm 14*a* in position.

In order to make device 10 unremovable from door 11 without first opening door 11, the total length of support member 12 (including the affixed portions 14*b* of telescoping connector arms 14) and either of its slidable arm portions 14*a*, must be greater than the width of door 11. Thus, the only way to remove a support member 12 from door 11 is to unfasten slidable arm portion 14*a* from the edge of door 11 and extend it outwards—and this can only be accomplished while door 11 is open.

Once a support member 12 is fastened in place as described above, near the bottom of the door, the lower edge of a sign 16 is inserted in pocket portion 13 thereof. Then the other support member 12 is positioned with its pocket portion 13 directed downwards, on top of sign 16 and secured in place in a similar fashion.

It can be seen that sign 16 cannot be removed from sign holder 10 so long as door 11 is closed. Also, since sign 16 and support members 12 are spaced away from the surface of door 11, no scratching or marring can occur.

Figure 5:
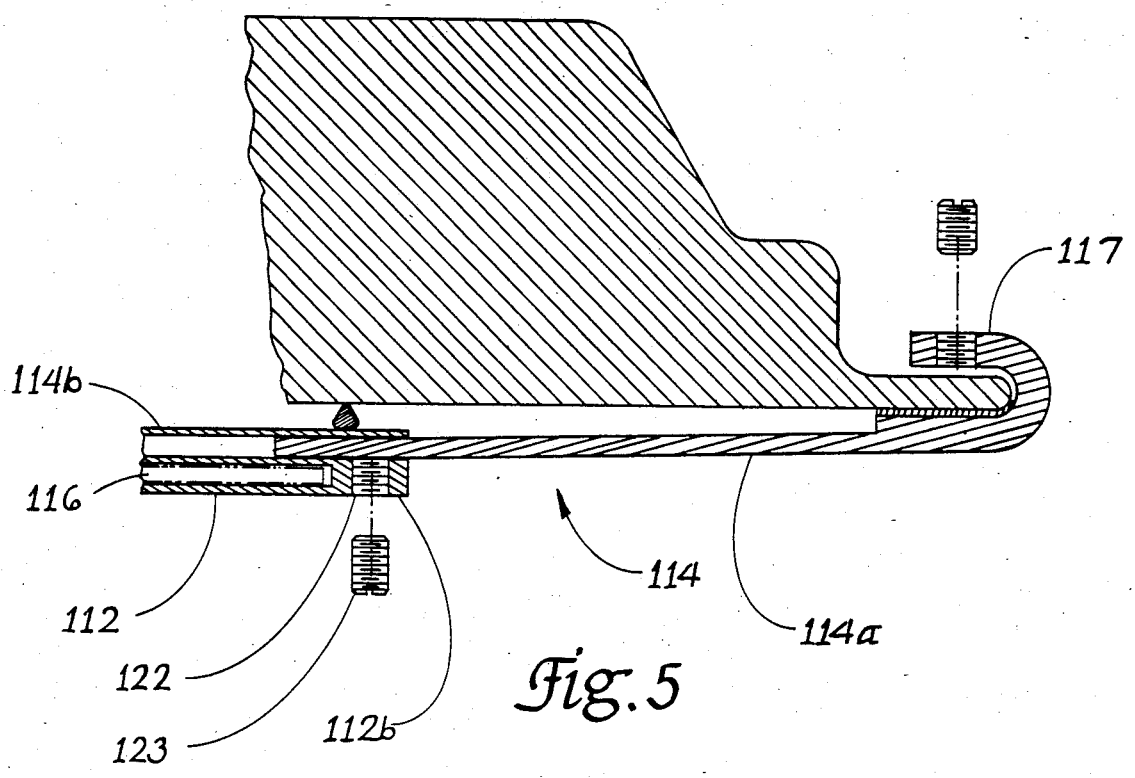
FIG. 5 is a super-enlarged cross-sectional view of another embodiment, taken at line 5—5 in FIG. 1.

Referring now to FIG. 5, another embodiment of the invention utilizes a support member 112 with affixed portions 114*b* of telescoping connector arms 114 attached thereto adjacent door 11. It should be noted that FIG. 1 also shows the second embodiment of the invention, as it would look the same in that view.

Since the amount that slidable arm 114*a* is flexed between affixed portion 114*b* and curved end 117 is less in this second embodiment, an aperture 122 is punched and tapped in each end 112*b* of support member 112 (this area could also be considered part of the affixed portion 114*b*) perpendicular to the longitudinal axis thereof. A threaded set screw 123 is inserted within aperture 122 and tightened against slidable arm 114*a* in affixed portion 114*b*.

It will be readily understood that the particular disposition or arrangement or nature of the elements of the invention are not of the essence of the invention, and that many variations, substitutions, and modifications may be made, in departure from the particular construction and characterization in the drawings and foregoing description, without departing from the true spirit of the invention. It is therefore to be understood that the invention should be limited only by the breadth and scope of the appended claims.

What is claimed is:

1. A vehicle door-mounted signholder, comprising:

an upper elongated support member having a pocket portion directed downwards;

a lower elongated support member having a pocket portion directed upwards;

whereby the upper and lower edges of a sign may be held between said upper and lower support members;

two telescoping connector arms each having a slidable portion and an affixed portion, the affixed portion of each mounted to an end of said upper support member, said arms having their free ends bent inwardly so as to fit around the edge of a vehicle door;

two telescoping connector arms each having a slidable portion and an affixed portion, the affixed portion of each mounted to an end of said lower support member, said arms having their free ends bent inwardly so as to fit around the edge of a vehicle door;

wherein the affixed portions of the telescoping connector arms are longitudinally slotted;

wherein the slidable portions of the telescoping connector arms are of a width and thickness such that said sleeve portions will be expanded slightly in cross-section; whereby said telescoping arms will be constrained to final position;

resilient spacer means affixed to the door-adjacent face of said support members;

wherein the total of the thickness of the wall of each one of the support members nearest the door forming a pocket portion and the depth of said spacer means is such that no part of a sign being held between said support members may come in contact with the door;

soft material affixed to the door-adjacent surface of said arms; and means for maintaining the desired vertical position of the connector arms.

2. The vehicle door-mounted sign holder of claim 1, wherein the position maintaining means are set screws in the bent end of said connector arms engaging the inside surface of said door edges.

3. A vehicle door-mounted signholder, comprising:

an upper elongated support member having a pocket portion directed downwards;

a lower elongated support member having a pocket portion directed upwards;

whereby the upper and lower edges of a sign may be held between said upper and lower support members;

two telescoping connector arms each having a slidable portion and an affixed portion, the affixed portion of each mounted to an end of said upper support member, said arms having their free ends bent inwardly so as to fit around the edge of a vehicle door;

two telescoping connector arms each having a slidable portion and an affixed portion, the affixed portion of each mounted to an end of said lower support member, said arms having their free ends bent inwardly so as to fit around the edge of a vehicle door;

wherein the total length of said upper support member and the affixed portions of its telescoping connector arms plus either of the slidable portions of the telescoping connector arms is greater than the width of the vehicle door;

wherein the total length of said lower support member and the affixed portions of its telescoping connector arms plus either of the slidable portions of the telescoping connector arms is greater than the width of the vehicle door;

resilient spacer means affixed to the door-adjacent face of said support members;

wherein the total of the thickness of the wall of each one of the support members nearest the door forming a pocket portion and the depth of said spacer means, is such that no part of a sign being held between said support members may come in contact with the door;

soft material affixed to the door-adjacent surface of said arms;

means for maintaining the desired vertical position of the connector arms; and set screw means in each of the bent ends of said connector arms engaging the inside surfaces of said door edges, for removably fastening said arms in position, whereby said elongated support members are fixed on the door upon fastening said set screws and said device may not be removed once the vehicle door is closed.

4. The vehicle door-mounted sign holder of claim 3, wherein the affixed portions of the telescoping connector arms are longitudinally slotted; and wherein the slidable portion of the telescoping connector arms are of a width and thickness such that said sleeve portion will be expanded slightly in cross-section, whereby said telescoping arm will be constrained to final position.

5. The vehicle door-mounted sign holder of claim 3, wherein said support member is attached to said car door with said affixed portion of the telescoping connector arms adjacent thereto, and set screws in apertures in the affixed portions may be tightened against the slidable portions of the connector arms to maintain the desired length thereof.

* * * * *